United States Patent [19]

Yagi et al.

[11] 4,150,178

[45] Apr. 17, 1979

[54] ALUMINUM DIFFUSION LAYER FORMING METHOD

[75] Inventors: Toshiro Yagi; Junichi Yamamoto, both of Hiroshima, Japan

[73] Assignee: Toyo Kogyo Co., Ltd., Hiroshima, Japan

[21] Appl. No.: 892,893

[22] Filed: Apr. 3, 1978

[30] Foreign Application Priority Data

Apr. 20, 1977 [JP] Japan ..... 52-46028

[51] Int. Cl.[2] ..... C23C 1/08

[52] U.S. Cl. ..... 427/380; 427/383 D; 427/431; 428/653

[58] Field of Search ..... 428/653; 427/253, 383 D, 427/380; 148/6.3

[56] References Cited

U.S. PATENT DOCUMENTS

| | | | |
|---|---|---|---|
| 2,970,065 | 1/1961 | Greene | 427/383 D |
| 3,079,276 | 2/1963 | Puyear et al. | 427/253 |
| 3,257,230 | 6/1966 | Wachtell | 427/250 |
| 3,577,268 | 5/1971 | Whitfield et al. | 427/253 |
| 3,764,373 | 2/1972 | Speirs et al. | 427/253 |
| 3,907,611 | 9/1975 | Sasame et al. | 148/6.3 |

*Primary Examiner*—Raph S. Kendall

*Attorney, Agent, or Firm*—Wenderoth, Lind & Ponack

[57] ABSTRACT

The invention relates to a method of forming aluminum diffusion layer including the steps of dipping a ferrous base alloy workpiece containing nickel of more than 8.0% by weight in a molten metal bath of aluminum or aluminum alloy having temperature of 650° to 750° C. for 30 to 120 seconds, subjecting the ferrous base alloy workpiece thus treated to a first heat treatment at temperature from 750° to 850° C. for at least 60 minutes, subsequently subjecting the ferrous base alloy workpiece thus treated to a second heat treatment at temperature of 900° to 1000° C. for at least 30 minutes, and further subjecting the ferrous base alloy workpiece thus treated to a third heat treatment under predetermined conditions at set temperatures and durations for the separation of an aluminum compound layer formed on the workpiece and for the formation only of aluminum diffusion layer on the surface of the workpiece.

5 Claims, 5 Drawing Figures

ALUMINUM DIFFUSION LAYER FORMING METHOD

BACKGROUND OF THE INVENTION

The present invention relates to a method of aluminum diffusion layer formation to be applied to various components or parts in which resistances to oxidization and heat are required, which method is particularly suitable for application to components or parts, for example, metallic products such as plate members, containers, pipes, etc., to be satisfactorily usable in the presence of elevated temperatures and strongly corrosive medium generally containing halogen gas or halogen compounds, and especially for parts in the exhaust systems of motor vehicles such as reactors, silencers and the like.

Conventionally, in the formation of aluminum or Al diffusion layers, there has been proposed a solid diffusion method (so called pack method) known as calorizing, for example, by U.S. Pat. Nos. 3,079,276 and 3,096,160 entitled "Vapor diffusion coating process", in which workpieces to be treated are buried in aluminum particles or powder of various metals or salts and are heated at high temperatures for a long time under reducing atmosphere to generate vapor of aluminum to be penetrated into the workpieces for consequent formation of Al diffusion layers on the surfaces of such workpieces.

The conventional Al diffusion layer forming method as described above, however, has such a disadvantage that not only facilities are required for maintaining the reducing atmosphere, but a considerable period of time, for example, two to four hours is required for the treatment, thus resulting in high cost of the final products.

There has also been conventionally proposed a melt plating method called "aluminizing", for example, by U.S. Pat. No. 3,907,611 entitled "Method of making ferrous metal having highly improved resistances to corrosion at elevated temperatures and to oxidization" and assigned to the assignee of the present invention. The known method as described above, however, is not intended to form the diffusion layer of Al, but to form Al plating layers or Al compound layers on the surfaces of workpieces to be treated, and is incapable of forming only the Al duffusion layer on the surface of the ferrous alloy workpiece as proposed in the present invention.

SUMMARY OF THE INVENTION

Accordingly, an essential object of the present invention is to provide a method of Al diffusion layer formation for application to components and parts requiring resistances against oxidization and heat which is particularly suitable for application in mass production at high efficiency.

Another important object of the present invention is to provide a method of Al diffusion layer formation as described above, without requiring preparation of a particular atmosphere, thus simplifying the method and reducing the cost of the final products.

A further object of the present invention is to provide a ferrous base alloy workpiece produced by the method as described above.

In accomplishing these and other objects, according to the present invention, there is provided a method of Al diffusion layer formation which comprises the steps of dipping a ferrous base alloy workpiece containing nickel of more than 8.0% by weight in a molten bath of aluminum or aluminum alloy having a temperature from 650° to 750° C. for 30 to 120 seconds, subjecting the workpiece thus treated to a first heat treatment at a temperature from 750° to 850° C. for at least 60 minutes, further subjecting the workpiece thus treated to a second heat treatment at a temperature from 900° to 1000° C. for at least 30 minutes, and subsequently subjecting the workpiece to a third heat treatment under predetermined conditions within the long time side region in FIG. 1 (mentioned later) defined by a line denoting 1050° C., a line indicating 1300° C. and a line showing 10 minutes and also sectioned by a curve line connecting a point A (1050° C., 90 minutes), a point B (1100° C., 40 minutes) and a point C (1150° C., 10 minutes) so as to cause an Al compound layer formed on the workpiece to be removed through separation for forming only an Al diffusion layer on the surface of the ferrous base alloy workpiece, by which procedures, the Al diffusion layer forming method particularly suitable for application to components and parts which require high resistances against oxidization and heat is advantageously presented, with substantial elimination of disadvantages inherent in the conventional methods.

It should be noted here that in the present invention, the layer formed on the surface of the workpiece by immersing or dipping the workpiece in the molten metal bath of aluminum or aluminum alloy is defined as an Al plating layer, and the layer mainly of Fe-Al compound formed on the surface of the workpiece by subjecting the resultant to heat treatment is defined as an Al compound layer, which another layer formed between the Al compound and the workpiece by diffusion of part of the Al compound layer into the workpiece is defined as an Al diffusion layer.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
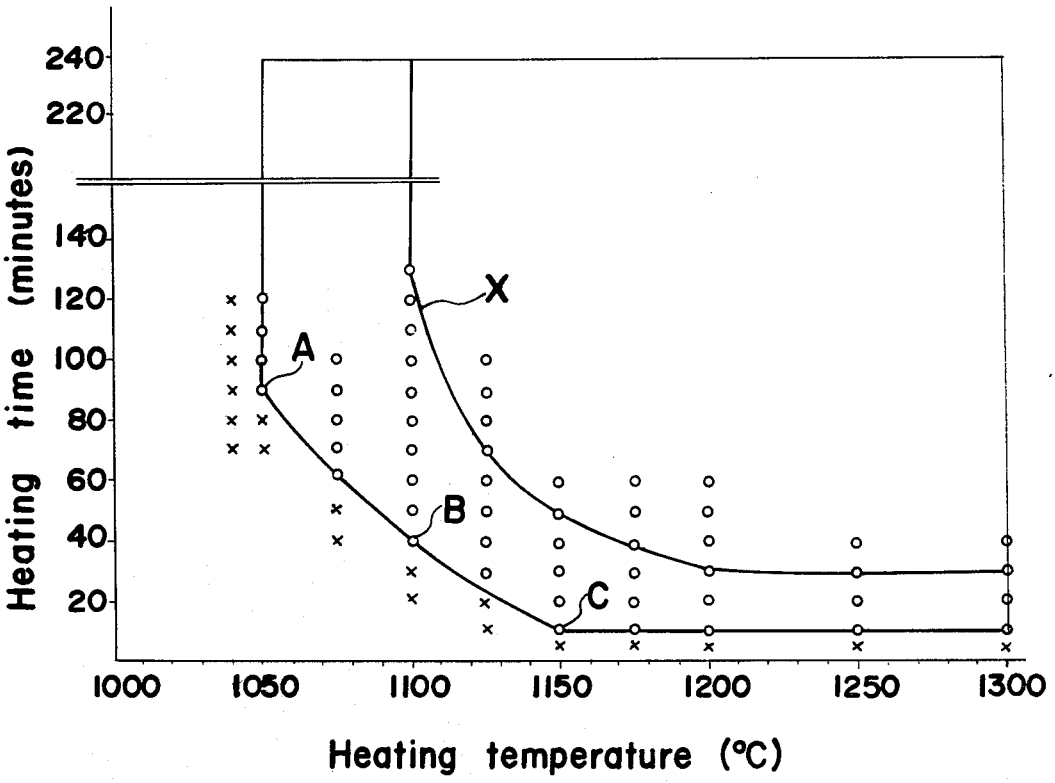
FIG. 1 is a graph showing correlation between temperature and time of the third heat treatment and state separation of Al compound layer according to the method of the present invention.

Referring now to the drawings, the present invention will be described in detail hereinbelow.

Before the description of the present invention proceeds, it is to be noted that the Al diffusion layer forming method of the present invention is characterized in that the ferrous base alloy workpiece contains nickel (Ni) in an amount of more than 8.0% by weight so as to cause Al to diffuse and penetrate by heat treatment into the ferrous base alloy workpiece from an Al plating layer formed on said workpiece by a melt plating method, through the characteristics of Ni and Al in multi-stage heat treatments, with subsequent removal, through separation, of an Al compound layer formed on the workpiece thus leaving only the Al diffusion layer on the surface of the ferrous base alloy workpiece.

As is known in the art, heating Al in a melted state together with Ni gives rise to undesirable reaction referred to as exothermic reaction which produces a large amount of heat during chemical combination, thus heavily eroding the ferrous base alloy workpiece containing Ni.

In order to eliminate the problem as described above, according to the present invention, Al is stabilized (i.e., making the amount of free Al small by causing Al to combine with Fe and the like at a temperature at which Al does not react with Ni) at a first heat treatment for subsequent diffusion of Al into the ferrous base alloy workpiece at a second heat treatment, while Ni in the ferrous base alloy workpiece is finally diffused toward the surface of said ferrous base alloy workpiece at a third heat treatment for coupling, at an upper portion of the diffused layer, with Al diffused inwardly from an Al compound layer formed on the uppermost layer, so as to form a layer of Al-Ni compound at said upper portion of the diffused layer for separating the Al compound layer for removal from the surface of the ferrous base alloy workpiece, with the Al-Ni compound layer being set as a boundary line. In the above case, since the combined amount of Al and Ni diffused in the workpiece is small per unit time, the resultant exothermic reaction is not so large as to present any significant inconvenience as described earlier.

(i) The ferrous base alloy workpiece:

The ferrous base alloy workpiece in the present invention contains Ni in an amount more than 8.0% by weight, and the so-called austenitic steel is particularly suitable for this purpose. Ni is required to separate the Al compound layer at the uppermost surface in the third heat treatment, and should be more than 8.0% by weight for sufficient separation. Although there is no definite upper limit set for the amount of Ni, less than 30% by weight is industrially advantageous from the viewpoints of cost and practical application.

(ii) The melt plating:

The melt plating is required for the formation of Al supply source on the surface of the ferrous base alloy workpiece to effect the Al diffusion and penetration according to the present invention. Sufficient stability can not be obtained at temperatures of the molten metal bath less than 650° C., while exceeding 750° C. is not desirable due to heavy erosion or corrosion of the surface of the base material by Al. On the other hand, if the dipping time is less than 30 seconds, metallurgical coupling of Al with the ferrous base alloy surface is not perfectly effected, while exceeding 120 seconds is not desirable, since the amount of erosion of the ferrous base alloy surface by the molten Al is increased. It is to be noted here that although any of molten Al baths of pure Al, Al-Cr alloys, Al-Si alloys, etc. may be employed for the Al melt plating, inclusion of Si is desirable from the viewpoint of efficient separation of the Al compound layer, in which case, the amount of Si should preferably be 5 to 11%.

(iii) The first heat treatment:

The first heat treatment is essential for converting a compound by forming an Al compound layer mainly composed of Fe-Al compound through reaction of unreacted Al on Fe at a comparatively low temperature at which such unreacted Al does not react on Ni, in order to prevent occurrence of the exothermic reaction between Al and Ni at the subsequent heat treatments at elevated temperatures. In the first heat treatment, Al is not sufficiently converted into the form of a compound at treating temperatures less than 750° C., while treating temperatures over 850° C. are also not desirable, since the exothermic reaction between Al and Ni begins to take place. On the other hand, heat treatment for less than 60 minutes is not desirable since Al is not sufficiently formed into compound, while exceeding 3 hours is not preferable from the viewpoint of productivity, although there is no particular upper limit set for the treating time.

(iv) The second heat treatment:

In the second heat treatment necessary for diffusing and penetrating Al into the ferrous base alloy from the Al compound layer, the treating temperature must be higher than 900° C. for efficient diffusion of Al, while a treating temperature over 1000° C. is not desirable, since at such high temperatures, formation of Al-Ni compound (mentioned later) obstructs the desirable diffusion and penetration of Al. Meanwhile, the treating time less than 30 minutes is not preferable due to insufficient diffusion and penetration of Al. Since there is no particular upper limit set for the treating time, it may be suitably adjusted depending on the thickness of the Al diffusion layer required, although treating time less than 3 hours is still preferable for industrial purposes.

(v) The third heat treatment:

The present invention is particularly characterized in the third heat treatment in which Ni in the ferrous base is diffused toward the surface of said ferrous base alloy to form a layer of Al-Ni compound at the boundary portion of the Al diffusion layer and Al compound layer, with further heating of the ferrous base alloy for continuously causing Ni in the ferrous base alloy to move toward the surface thereof for diffusion (Ni is capable of passing through the Al-Ni compound layer). In the above case, since it is difficult for Al to be passed through the Al-Ni compound layer, diffusion only of Ni toward the surface is maintained. Consequently, change in volume due to discharge of Ni takes place to form, in the inner side of the Al-Ni compound, very fine pores which grow to be connected to each other so as to constitute cracks. In the manner as described above, the Al compound layer is separated from the ferrous base alloy as the latter is cooled from elevated temperatures, by the presence of the cracks produced at the boundary portion between the Al compound layer and Al diffusion layer, and thus the ferrous base alloy workpiece having only the desired Al diffusion layer on the surface is obtained. In the third heat treatment, the treating temperature should be higher than 1050° C. for sufficient separation of the Al compound layer, while exceeding 1300° C. is undesirable since the ferrous base alloy becomes brittle. On the other hand, the treating time less than 10 minutes is insufficient for perfect separation even at elevated temperatures. Furthermore, even with treating temperatures between 1050° C. and 1300° C. and treating time over 10 minutes as described above, if such treating conditions are in the short time side region defined by the line connecting the points A (1050° C. for 90 minutes), B (1100° C. for 40 minutes) and C (1150° C. for 10 minutes) in FIG. 1, sufficient separation of the Al compound layer can not be expected, either. Although difference in the upper limits of the treating time may slightly affect the thickness of the Al diffusion layer to be formed, such thickness differs depending on material and inherent thickness of the workpiece to be treated, and therefore the upper limit of the treating time as mentioned above may suitably be adjusted according to the thickness of the required Al diffusion layer. It is to be noted here, however, that when the productivity is taken into account, the treating time should preferably be within 4 hours at the short time side region sectioned by a line X in FIG. 1 for practical purpose, and that the thickness of the Al diffusion layer should preferably be over 90μ and less than 1/6 of the average thickness of the workpiece.

(vi) The correlation between the treating temperature and treating time and separation of the Al compound layer (FIG. 1):

The graph of FIG. 1 obtained by experimental measurements of the temperatures and time required for separation of the Al compound layer in the third heat treatment illustrates the state of separation of the Al compound layer, when a large number of samples prepared by subjecting the ferrous base alloy workpieces as employed in Example 1 (mentioned later) to the Al melt plating and first and second heat treatments are further heat-treated at different temperatures for different periods of time. In FIG. 1, marks o denote good state of separation, while marks x represent poor state of separation. As is clear from FIG. 1, it is noted that all the samples treated at temperatures over 1050° C. for more than 10 minutes and lying at the high temperature and long time side in the region sectioned by the line connecting the points A, B and C show favorable separating state. It is to be noted here that the line X represents a boundary line whereat a workpiece of 2.5 mm thickness treated according to the method of the present invention is deformed beyond a permissible range, and that treating conditions should preferably be in the range below the line X when a steel plate is used for the workpiece.

The following examples are for the purpose of illustrating the present invention without any intention of limiting the scope thereof.

EXAMPLE 1

(a) Ferrous base alloy—austenitic stainless steel having a composition of 0.05% C, 3.5% Si, 0.3% Mn, 18.5% Cr, 13.0% Ni, 1.0% Cu and remainder of Fe was employed.

(b) Al melt plating—a steel plate prepared from the ferrous base alloy as described above (2.5 mm thick) was dipped for 60 seconds in a molten alloy bath having a composition of 10% Si and remainder of Al and maintained at a temperature of 730° C., and was then taken out therefrom.

(c) First heat treatment—the steel plate to be treated which had been subjected to the melt plating in the step (b) above was heated at a temperature of 780° C. for 90 minutes.

(d) Second heat treatment—the steel plate which has been heat-treated in the step (c) above was further heated at a temperature of 950° C. for 60 minutes.

(e) Third heat treatment—the steel plate which had been heat-treated in the step (d) above was further heated at a temperature of 1110° C. for 60 minutes with subsequent cooling by air, and thus the Al compound layer formed on the steel plate surface was separated for removal.

EXAMPLE 2

(a) Ferrous base alloy—austenitic stainless steel (AISI 310S) having a composition of 0.05% C, 1.3% Si, 1.5% Mn, 25.0% Cr, 20.5% Ni and remainder of Fe was employed.

(b) Al melt plating—a steel plate prepared from the ferrous base alloy as described above (2.0 mm thick) was dipped for 100 seconds in an Al molten bath maintained at a temperature of 715° C., and then was taken out.

(c) First heat treatment—the steel plate to be treated which had been subjected to the melt plating in the step (b) above was heated at a temperature of 820° C. for 70 minutes.

(d) Second heat treatment—the steel plate which had been treated in the step (c) above was further heated at 980° C. for 40 minutes.

(e) Third heat treatment—the steel plate which had been heat-treated in the step (d) above was further heated at 1200° for 30 minutes with subsequent cooling by air, and thus the Al compound layer formed on the steel plate surface was separated for removal.

Figure 2:
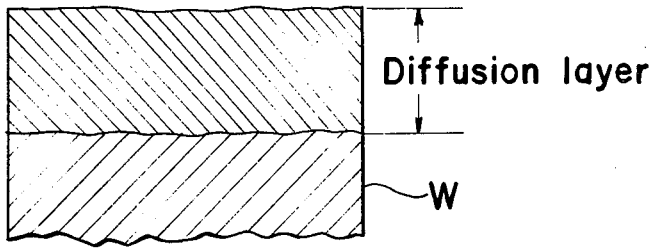
FIG. 2 is a fragmentary cross sectional view showing the structure in the surface of a workpiece treated by the method according to the present invention, FIGS. 3(*a*) and 3(*b*) are scanning diagrams obtained by an electron probe microanalyzer showing diffusion of Al and Ni before and after the third heat treatment according to the method of the present invention.
Figure 3A:
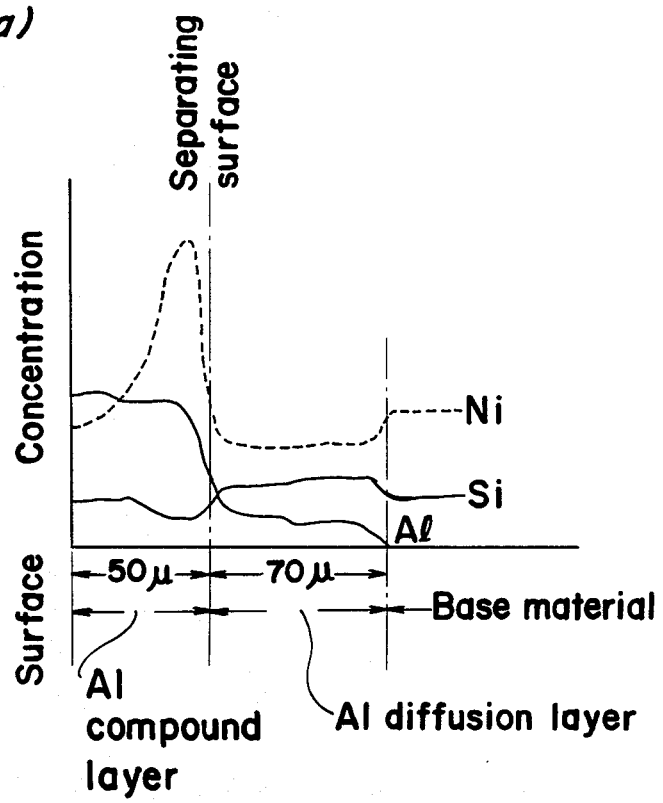
Figure 3B:
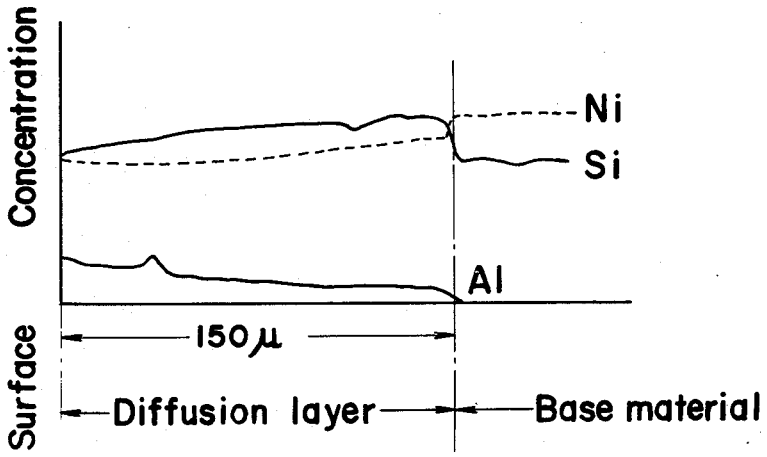

The resultant products obtained by the procedures of both Examples 1 and 2 as described above had a structure as shown in FIG. 2, with the thickness of the Al diffusion layer formed on the workpiece W being 150μ in Example 1 and 170μ in Example 2. From scanning diagrams obtained by an electron probe microanalyzer (known as EMX) in FIGS. 3(*a*) and 3(*b*) and showing the state of diffusion of various elements from the surfaces of the samples in Example 1 before and after the third heat treatment, it is noticed that the separation took place due to presence of Ni concentrated over the separating surface, and that distribution of Al concentration in the Al diffusion layer after the separation is stabilized. Furthermore, upon scanning of the separated surface through X-ray diffraction, presence of $FeAl_3$ as noticed in the conventional caloring method was not noticed.

The samples obtained in Examples 1 and 2 as described above were subsequently subjected to the oxidization resistance tests as follows.

Figure 4:
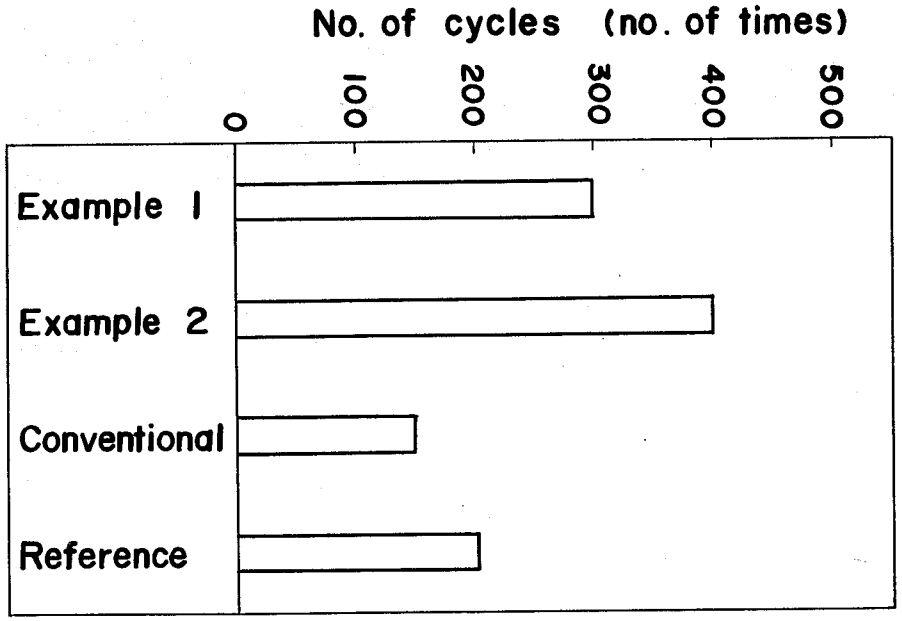
FIG. 4 shows results of comparative tests for resistance against oxidization between the workpieces treated by the method according to the present invention and those treated by conventional methods.

Samples each prepared by treating a cylindrical ferrous base alloy workpiece having external diameter of 90 mm, thickness of 2.5 mm and length of 120 mm in the procedures as described in Examples 1 and 2 were heated by a propane gas burner to raise their temperature from 200° C. to 1200° C. for 4 minutes, with subsequent cooling by air for 3 minutes down to the original temperature of 200° C. The process as described above was set to be one cycle, and such heating and cooling were continuously repeated to measure the number of cycles until a point whereat reduction of amount due to oxidization is suddenly increased (known as "breakaway" point) is reached. The results are shown in FIG. 4 wherein results for the conventional sample were obtained by testing, under the same conditions, samples prepared by forming the Al diffusion layer on a ferrous base alloy workpiece similar to that in Example 1 through the known calorizing method, while results for the reference sample were obtained by testing, under the same conditions, samples prepared by dipping a steel plate similar to the workpiece in Example 1 in a molten metal bath of similar composition at a temperature of 730° C. for 60 seconds and subsequently subjecting the steel plate thus treated to heat treatment at a temperature of 800° C. for 90 minutes, with further heating of the steel plate thus treated at a temperature of 950° C. for 60 minutes for the formation of the Al diffusion layer. In the reference sample, the resultant Al diffusion layer had a thickness of only 80μ.

As is clear from the foregoing description, it is noticed that the products obtained by the method according to the present invention is by far superior, in the oxidization resistance, to the products obtained by the conventional methods. The poor oxidization resistance in the products according to the conventional calorizing method is considered to be due to the fact that deformation and cracks result from excessively thick Al diffusion layer so as to initiate the undesirable oxidization therefrom. By way of example, the Al diffusion layer in the product according to the conventional calorizing method has a thickness as large as 500μ as compared with a thickness of 150μ in Example 1 and 170μ in Example 2, which difference is considered to have been brought about by the fundamental difference between the Al diffusion layer forming method according to the present invention and the conventional method.

In the processing of the products, no inconvenience is experienced during welding of the products according to the method of the present invention, since the Al plating layer, Al compound layer and the like which are inherent in the surfaces of conventional products subjected only to the melt plating are not present in the products according to the method of the present invention.

Similarly, in the products according to the method of the present invention, deformation to a certain extent is also possible, since the brittle coating as in the products subjected only to the melt plating is not present.

Accordingly, the Al diffusion layer forming method of the present invention is capable of providing products superior in processability and welding performance in addition to the good resistance against oxidization, and is particularly suitable for employment in mass production as an efficient processing method, for example, of exhaust system components and parts of motor vehicles and the like.

Although the present invention has been fully described by way of example with reference to the attached drawings, it is to be noted that various changes and modifications are apparent to those skilled in the art, and therefore unless otherwise such changes and modifications depart from the scope of the present invention, they should be construed as included therein.

What is claimed is:

1. A method of forming an aluminum diffusion layer comprising the steps of dipping a ferrous base alloy workpiece containing nickel in an amount of more than 8.0% by weight in a molten metal bath of aluminum or aluminum alloy having a temperature of 650° to 750° C. for 30 to 120 seconds, subjecting the workpiece thus treated to a first heat treatment at a temperature from 750° to 850° C. for at least 60 minutes, subsequently subjecting the workpiece thus treated to a second heat treatment at a temperature of 900° to 1000° C. for at least 30 minutes, and further subjecting the workpiece thus treated to a third heat treatment under conditions within a long time side region, which is defined by lines denoting 1050° C., 1300° C. and 10 minutes and sectioned by a line connecting points A (1050° C., 90 minutes), B (1100° C., 40 minutes) and C (1150° C., 10 minutes) shown in FIG. 1 of the attached drawings, so as to cause an aluminum compound layer formed on said workpiece to be removed through separation from said workpiece for formation only of an aluminum diffusion layer on the surface of said workpiece.

2. A method of forming an aluminum diffusion layer as claimed in claim 1, wherein said ferrous base alloy workpiece is made of austenitic stainless steel.

3. A method of forming an aluminum diffusion layer as claimed in claim 1, wherein said molten metal bath of aluminum alloy is an alloy of aluminum and silicon.

4. A method of forming an aluminum diffusion layer as claimed in claim 1, wherein said first and second heat treatments are carried out for less than three hours respectively.

5. A method of forming an aluminum diffusion layer as claimed in claim 1, wherein said third heat treatment is set, in its treating temperature and time, at a range smaller than indicated by line X in FIG. 1 of the attached drawings.

* * * * *